United States Patent [19]

Zimmern

[11] Patent Number: 4,534,719

[45] Date of Patent: Aug. 13, 1985

[54] VOLUMETRIC SCREW-AND-PINION MACHINE AND A METHOD FOR USING THE SAME

[76] Inventor: Bernard Zimmern, 27, rue Delabordére, 92200 Neuilly sur Seine, France

[21] Appl. No.: 492,637

[22] Filed: May 9, 1983

[30] Foreign Application Priority Data

May 13, 1982 [FR] France ..... 82 08324

[51] Int. Cl.[3] ..... F04C 2/00; F04C 18/00

[52] U.S. Cl. ..... 418/195

[58] Field of Search ..... 418/195, 196, 197, 201

[56] References Cited

U.S. PATENT DOCUMENTS

| | | | |
|---|---|---|---|
| Re. 29,283 | 6/1977 | Shaw | 418/201 |
| 3,804,564 | 4/1974 | Zimmern | 418/195 |
| 4,261,691 | 4/1981 | Zimmern | 418/195 |

FOREIGN PATENT DOCUMENTS

| | | |
|---|---|---|
| 2177171 | 11/1973 | France . |
| 2321613 | 3/1977 | France . |
| 1555330 | 11/1979 | United Kingdom . |
| 2053360 | 2/1981 | United Kingdom . |

*Primary Examiner*—Leonard E. Smith
*Assistant Examiner*—Jane E. Obee
*Attorney, Agent, or Firm*—Ziems, Walter & Shannon

[57] ABSTRACT

A volumetric machine comprises a cylindrical screw meshing with a pinion-wheel, a low pressure port near one end of the screw, a high pressure port near the other end of the screw, and a control slide axially movable in the bore of a housing in which the screw is rotatable. In one condition, including a series of positions, the slide more or less broadens the high pressure port and thus controls the volumetric ratio of the machine, but covers any threads of the screw which are meshing with the pinion-wheel. In another condition, the slide closes the high pressure port except a stationary port but uncovers some of the threads meshing with the screw, such as to establish a part load with a predetermined volumetric ratio.

11 Claims, 12 Drawing Figures

VOLUMETRIC SCREW-AND-PINION MACHINE AND A METHOD FOR USING THE SAME

Figure 1:
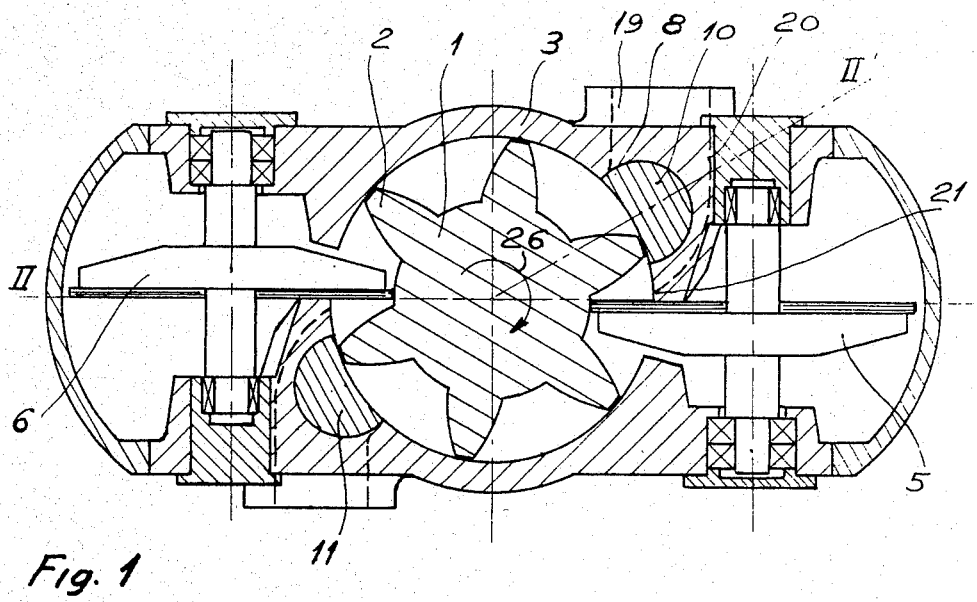

This invention relates to a volumetric screw-and-pinion machine having a variable volumetric ratio.

This invention also relates to a method for using the same.

It is well known that a basic screw compressor has the major drawback of having a fixed compression ratio which poorly suits variable pressures such as those encountered in refrigeration compressors or heat pumps. It results in important thermodynamic losses when the compressor operates under compression ratios quite different from the built-in one.

For example a heat pump built to operate with a compression ratio of 3:1 provides under a compression ratio of 6:1 an efficiency reduced by 10 to 15% with respect to the value which would have been reached with a compressor built to operate at such a compression ratio.

One has tried to remedy this defect by various devices, but none is really satisfactory.

For instance, French Pat. No. 2,177,171 shows a discharge port comprising several holes provided with valves but in practice this embodiment loses a part of its energy through the reduction of the passage area caused by the metal between the holes, and the resulting pressure drop.

Another device consists in using the slide described in French Pat. No. 2,321,613 but without creating an opening on the low pressure side. It is then possible to set the discharge point earlier or later, and thus to vary the compression ratio, but the possibility to vary the capacity—or delivery—is lost, although it is an essential requirement in refrigeration compressors and heat pumps.

The volumetric ratio of a screw and pinion-wheel machine is the ratio between the volume of the gas when just trapped in a groove and the volume of the gas when the groove begins to register with the exhaust port. Thus, the volumetric ratio is determined by the configuration of the machine, and this is true for a compressor as well as for an expansion machine. If the operating conditions are given, (e.g., speed of the machine, as well as the nature, pressure and temperature of the gas), the volumetric ratio determines the ratio between the pressure of the gas when just trapped in a groove and the pressure of the gas when the groove begins to register with the exhaust port. Therefore, the volumetric ratio and compression ratio are often used for one another, but strictly speaking, the ratio determined by the geometry or configuration of the machine should be called "volumetric ratio". "Delivery", "capacity" and "load" are synonymous for expressing how much gas is trapped in the grooves.

The object of the invention is to realize a volumetric machine permitting, without excessive strutural complexity, of varying its delivery as well as its volumetric ratio.

According to the invention, there is provided a volumetric screw-and-pinion machine such as a compressor or an expansion machine comprising, in a combination, a screw having a cylindrical outer profile, provided with several threads and rotatably mounted inside a stationary casing, at least one pinion-wheel meshing with the screw, and a slide displaceably mounted near the pinion-wheel in a channel made in the casing parallel to the axis of the screw, the slide comprising a body located in the channel and having a concave face which matches with the cylindrical outer profile of the screw and two end edges, one of which is on a low-pressure side of the body and the other is on high pressure side of the body, a stationary high pressure port being provided in the casing between the pinion-wheel and the slide, wherein the slide is movable between two series of positions, i.e. one series of full load positions in which the slide body uncovers in the casing beyond the high pressure edge, a variable orifice in connection with the high pressure while the slide body, the variable orifice and the stationary port are together substantially covering the threads of the screw which are in mesh with the pinion-wheel; and a part-load position in which the slide body uncovers away from its high pressure edge at least part of the threads which are in mesh with the pinion-wheel teeth and substantially obturates the variable orifice.

The slide is thus used in an optimal way; when displaced towards the low pressure end of the screw, one can adjust its position to vary the volumetric ratio; on the contrary when displaced towards the discharge end of the screw it occupies a fixed location ensuring a predetermined part load.

Obviously in the part load position, the volumetric ratio cannot be varied but the effects on the efficiency are small:at part load, shaft power is reduced and there is much less to gain by optimising the volumetric ratio.

Moreover, as the part load position is pre-determined, the stationary discharge port may be dimensioned so that the volumetric ratio be around the average value of the volumetric ratios encountered and thus minimise the losses due to ratio mismatch.

In a preferred embodiment, the machine is a compressor comprising, in a combination, a screw having a cylindrical outer profile, provided with several threads and rotatably mounted inside a stationary casing and at least two pinion-wheels meshing with the screw, such as to constitute at least two part-compressors each of which is in accordance with the above specifications.

According to another aspect of the invention, the method of using such a compressor comprises the steps of choosing between a full load operation and a first part-load operation; axially displacing the two slides to a full-load position providing a desired volumetric ratio if the full-load operation is chosen, and setting one of the slides in a part-load position and axially displacing the other slide to a full-load position providing a desired volumetric ratio if the first part-load operation is chosen.

If, for instance the compressor operates with a volumetric ratio-compression ratio in case of a compressor—such that it would lose 15% in efficiency if one could not adapt its compression ratio, these 15% are gained at full load; if now one of the slides is at part load and the corresponding half-compressor absorbs for example one fourth of the power, one gains nothing on that fourth but one recuperates 15% on the other side, which represents half the shaft power. This represents a total gain of 10%, or in other words two thirds of what would be achieved if the compression ratio of both half-compressors could be optimised.

The screw of a screw compressor advantageously cooperates not only with one, but at least two pinion-wheels because the delivery may be substantially twice that which would be obtained with only one pinion, while the size and cost of the machine are increased by far less than twice. Where two pinion wheels are employed, a compressor can be considered as made of two part-compressors. The HP/LP ratio of a compressor is the ratio between the pressures in the high pressure and low pressure ports. According to the example given, the efficiency of the compressor would be increased by 15% if the volumetric ratio could be fully adapted to the HP/LP ratio. In addition, in the example, the needed capacity is 75% of the maximum capacity of the compressor. If the slide of each half compressor is in the full load position, the compressor will operate at full or 100% capacity. In order to obtain 75% capacity, the slide of one half compressor is set in a full capacity position, so that the half compressor will deliver 50% of the full capacity of the compressor. The slide of the other half compressor is set in a part capacity position, which causes the second half compressor to operate at half of its maximum capacity. Therefore, the capacity of the second half compressor with the slide in such a position is 25% of the full capacity of the compressor, so that the capacity of the overall machine is 50%+25%=75% of the maximum capacity. Since the slide of the first half compressor is in a full capacity position, it allows adjustment of the volumetric ratio. Since a volumetric ratio adjustment allows an increase in efficiency of 15% on the half compressor on which the adjustment is made, and since the half compressor on which the adjustment is made contributes $\frac{2}{3}$ of the actual capacity of the compressor, that is, 50% of the 75% capacity at which the compressor is operating, the general efficiency of the compressor is increased by 15% times $\frac{2}{3}$, or 10%. Of course, the volumetric ratio of the other half compressor cannot be adjusted in no efficiency increase is realized there.

Only when both slides are in a part load position nothing at all is gained; but then the absolute value of the shaft power is generally below half the full load shaft power and the losses caused by a defective volumetric ratio are therefore minimal.

Two preferred embodiments are especially favourable. In a first embodiment, both slides have the same part load position, corresponding for instance to one third of the full load capacity. The compressor can thus operate with the two slides in full load positions, at 66% load with one slide at a part load position and at 33% load with both slides at part load positions.

In the 100% position, the losses due to compression ratio mismatch can be eliminated; in the 66% position, it is still possible to eliminate approximately two-thirds of the mismatch losses by adjusting the slide operating at 100% load. In the 35% position, no more adjustment is possible.

In a second embodiment the slides have different part load positions; it is then possible, by moving one or the other, or both simultaneously, to obtain three part load conditions and for two of them, an optimization of the compression ratio through the slide left in a full load condition remains possible. Thus it is also possible to save energy in those operating conditions where the shaft power taken by the compressor is important; only the position with the smallest consumption, for the part load giving the smallest capacity, permits no adjustment of the compression ratio.

For instance one can arrange one of the slides to have a part load corresponding to 50% of the capacity of the half-compressor it controls while the other has a capacity corresponding to zero, both these values allowing besides a good efficiency of each half-compressor.

One can obtain so the value 75%, 50% and 25% and the adjustment of the compression ratio is possible fully at 100%, partly at 75% and 50% load and not at all at 25% load.

One interest of this invention is, on the one hand, to permit this new function of adjusting the volumetric ratio without having to add supplemental components, just by a convenient arrangement of existing means, and on the other hand to permit moving the slides by simple means inasmuch as it is for instance possible to use the same piston to automatically adjust the location of the slide to the theoretical volumetric ratio and to set it in a part load position, as will be seen hereinbelow.

In a preferred embodiment, the body of each slide is formed by two elements separated transversally with respect to the axis of the slide, the element located on the low pressure side being provided with biasing means urging it towards the high pressure and with a stop limiting its travel towards the high pressure.

Figure 2:
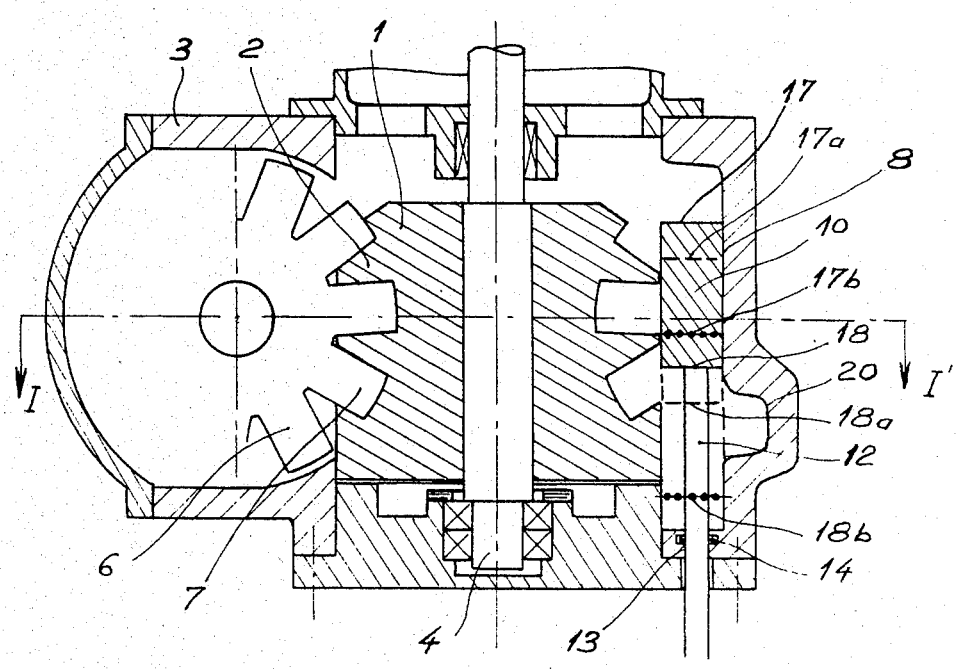
Figure 3:
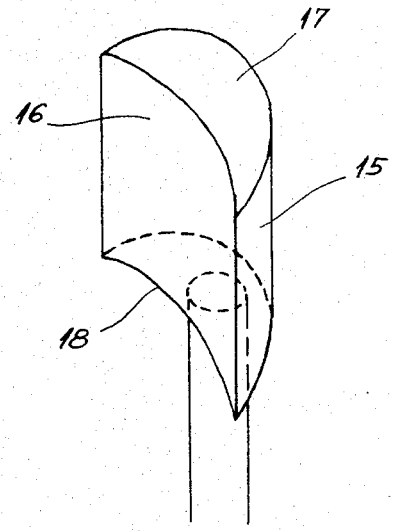
Figure 4:
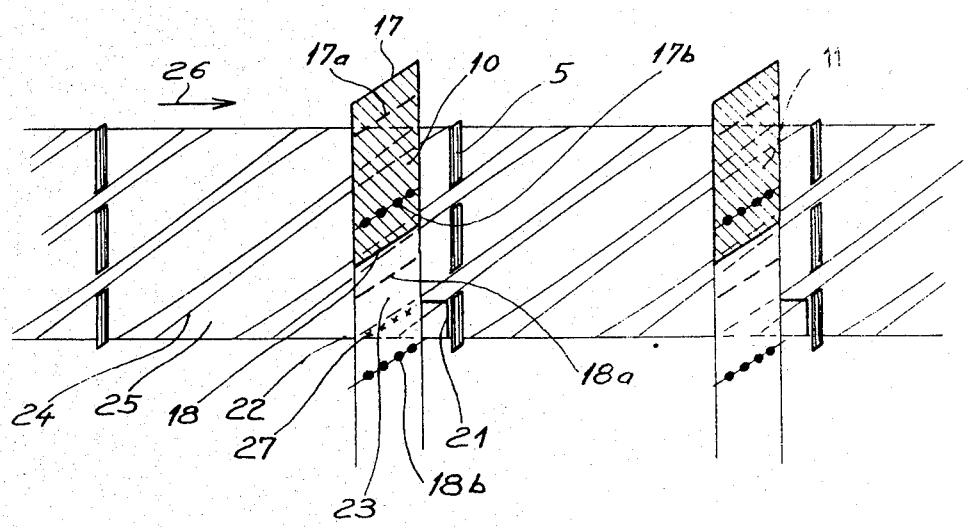
Figure 9:
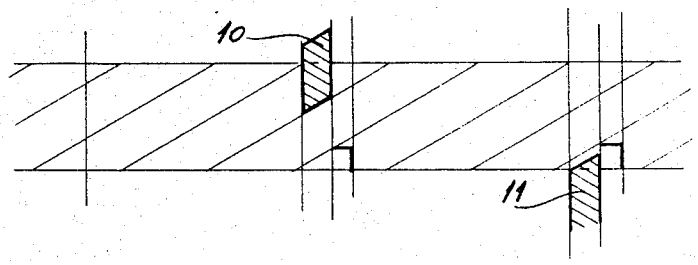
Figure 10:
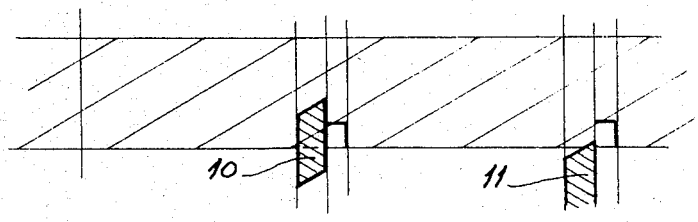
Figure 11:
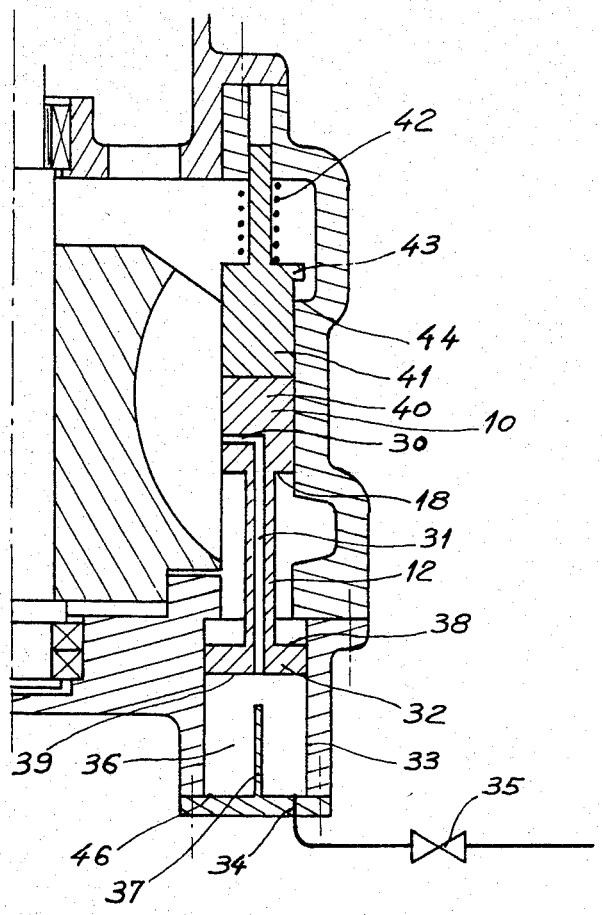
Figure 12:
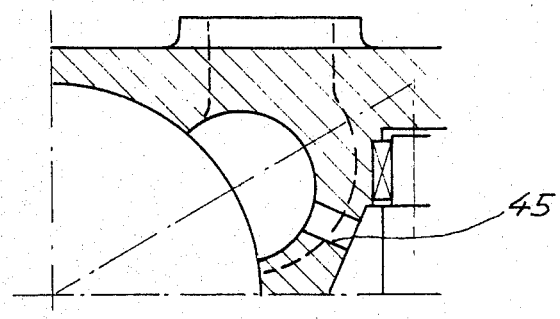

This invention shall be understood more easily by the following specification given by way of non limiting examples shown in the attached drawings in which:

FIG. 1 is a sectional view, perpendicular to the axis of the screw, of a compressor provided with slides according to the invention, the section being taken along I—I of FIG. 2, FIG. 2 is a part view, cut along II—II of FIG. 1, FIG. 3 is a perspective view of a slide of the compressor of FIGS. 1 and 2, FIG. 4 is a stretched view of the screw showing the positioning of the slides, FIGS. 5 to 10 show schematically the positions of the slides for various load conditions, FIG. 11 is a sectional view, similar to FIG. 2, showing another, preferred, alternative embodiment, FIG. 12 is a sectional part view of the embodiment of FIG. 11, cut along a plane perpendicular to the axis of the screw.

In the embodiment of FIGS. 1 and 2, the compressor comprises a screw 1 having a generally cylindrical outer profile and provided with threads 2. The screw is mounted for rotation about its axis 4 inside a casing 3, is driven in rotation in the direction of arrow 26 by motor means or the like not shown, and meshes with two pinion-wheels 5 and 6 provided with teeth such as 7 engaging the threads 2.

In a known way, especially disclosed in French Pat. No. 2,321,613, the casing 3 has on its internal face substantially leak-tightly surrounding the thread-crests of the threads, two channels 8 each of which is parallel to the axis 4 and made near a respective one of pinions 5, 6. Slide bodies 10, 11 are slidably mounted in the channels 8 and can be displaced therein by control means such as rods 12 sliding in bores 13 of the casing, and provided with sealing means like an O-ring 14 ensuring leak-tightness with respect to the outside.

As shown in the perspective view of FIG. 3, a slide body is comprised between a face formed as a portion of a convex cylinder 15, sliding in the channel 8 which is shaped accordingly, a concave wall facing the inside of the casing and matching the outer cylindrical shape of the thread-crests of the screw, an edge 17 limiting the body on the low pressure side and an edge 18 limiting it on the high pressure side. The edge 17 has been shown sloped, with a slope parallel to that of the threads, but it could also be straight without changing the invention.

FIG. 4 shows a stretched view of the threads of the screw and, in hatched lines, the bodies of the slides 10 and 11.

There is also shown on FIG. 1, in dotted lines, a high pressure orifice 19 which forms a volume, the outline of which, seen in 20, encompasses a part of the channel of the slide and terminates in the casing in 21 by a stationary orifice, known per se, shown in FIG. 4, located between the channel of the slide and the adjacent pinion (5 for instance).

In the position of the slide in FIG. 2 and FIG. 4 (hatched) there is left between the edge 18 and the end 22 of the threads, an orifice 23 which communicates with the high pressure orifice 19; moreover, the edge 17 overlaps on the low pressure side beyond line 24, which indicates the border of the thread-groove 25 that has just been isolated from low pressure by the tooth of pinion 5.

It is possible to move the slide so as to bring the edge 18 to 18*a* and the edge 17 to 17*a;* in this new position, the section of the orifice 23 has been changed and the instant when the thread groove being compressed begins registering with the variable orifice 23 is postponed; this results in the volume of the thread at the time of discharge having decreased and, therefore, the compression ratio is increased if the quantity of gas which has been trapped in the groove has not varied; this is just what happens because the edge 17 having moved to 17*a,* the body of the slide 10 still covers all of the thread-grooves such as 25 which have not yet registered with stationary port 21.

It is thus possible in this series of positions such as shown in 17, 18 and 17*a,* 18*a* to vary the compression ratio without varying the capacity. There are an infinite number of positions which differ by infinitesimally small increments from one another and in which the top edge 17 of the slide can be placed to result in a full capacity operation of the machine. These positions collectively comprise a full load condition for the half compressor containing this slide.

This series of positions is located within a certain interval, as, in the extreme case, the edge 18 cannot be moved upwards beyond the position shown in 24 corresponding to a compression ratio of 1, and in practice will remain in positions corresponding to compression ratios exceeding 2 or 2.5; on the other hand, there is no use to have edge 18 go beyond line 27, shown by crosses, because this would not delay any more the discharge point which would then be defined by the stationary port 21; the interval comprised between lines 24 and 27 constitutes thus the maximum travel of the edge 18 when the compressor is at full load. It should be noted that, even when the edge 18 comes to 27, the body of the slide is sufficiently long to reach line 24 or its vicinity so as to vary the swept volume not at all or else little. If now the slide is pushed much further towards the high pressure in the position shown by 17*b,* 18*b,* the slide unmasks beyond its low pressure edge 17*b* at least part of a thread-groove such as 25 meshing with the pinion, and compression can only begin when, due to rotation of the screw, the edge 24 reaches the edge 17*b,* as the gas that has been heretofore swept by the tooth 5 has been returned to low pressure via the channel 8.

This results in a reduced swept volume. It shall be noticed that while the positions taken by he body of the slide in full load condition such as 17 or 17*a* are infinite, as they may be chosen at random in a rather wide interval, there has been provided only one part load position such as 17*b*–18*b.*

In said part load position, the compression ratio does not vary and is determined by the ratio of the volume of a thread-groove when the edge 24 reaches the edge 17*b* and the volume of said groove when it begins registering with the stationary port 21. But it is possible to choose said position 17*b* and the dimension of port 21 so that the compression ratio so obtained be around the average of the compression ratios required from the compressor.

This would not be possible with a continuously varying capacity or with a plurality of part load positions.

The series of full load positions, which collectively comprise a first condition, can best be understood with reference to FIG. 4. Assume that the slides 10 and 11 and the channels accommodating them are not provided where a thread groove 25 has just been closed by a pinion-tooth 5 which traps a quantity of gas in the groove. Before closure by the pinion-tooth 5, the groove was in communication with the low pressure which prevails at the upper axial end of the screw. While the screw rotates in the direction of arrow 26, the pinion-tooth runs along the groove, compressing the trapped gas toward the lower end of the groove. When the lower end of the groove begins to register with the stationary exhaust port 21, the compressed gas is discharged into that port. Assume now that the slides and channels are provided and that the slide on the left is in the hatchwed position, that is, the position defined by the dashed lines 17*a* and 18*a.* This does not change the conditions for closure of the groove 25 by the pinion-tooth 5. Specifically, the slide has a surface 16 (FIG. 3) adjacent the screw, which is flush with the bore of the casing. Since in this slide position, the surface 16 extends beyond the low pressure end (the top) of the screw when the tooth 5 meashes with the groove 25, the groove is externally closed by the casing and by the slide, and the gas in the groove is trapped as if there were no slide device. Therefore, the quantity of gas which is trapped is at a maximum when the slide is displaced toward the lower pressure end of the screw.

However, in the dashed line position of FIG. 4, the slide leaves unmasked a variable orifice 23 which communicates with the stationary high pressure port 21. The variable orifice 23 has a position and shape such that, as the screw rotates, the groove 25 registers with the recess 23 before registering with the port 21. Thus, when the groove begins to register with the high pressure in this case, the volume of the groove is larger than in the case where there is no slide device and no orifice 23, but only port 21. If the slide is displaced in its groove so as to vary the size of the orifice 23 but not even partly uncover the groove, such as 25, which is just being closed by a pinion-tooth, such as 5, the capacity will remain maximum, but the size of the recess 23 will vary so that each groove will register sooner or later than before with the high pressure region, thus varying the volumetric ratio of the machine. Therefore, the dashed line position 17*a,* 18*a* of the slide belongs to a series of positions in which the capacity is maximum and the volumetric ratio varies.

If the slide is moved to the high pressure (the bottom) end of the screw, in the position shown by the lines 17*b* and 18*b,* the orifice 23 disappears so hat each groove registers with the high pressure region only when registering with the stationary port 21. However, in this position, the slide leaves partly uncovered the groove 25 which has just meshed with the tooth 5. Therefore, despite closure by the tooth 5, the groove 25 still communicates with the low pressure region until the rear wall 24 of the groove 25 registers with line 17*b*. At this point, the groove is closed but its volume is now reduced, and the capacity of the machine is correspondingly reduced. It is possible to adjust the capacity by more or less displacing the slide toward the high pressure end, since this will result in a variable volume of the groove when it is just closed. In the case of an expansion machine, the high pressure port is the intake port, and the screw rotates in a direction contrary to the arrow 26.

When the machine according to the present invention is used as an expansion machine, in the second position of the slide, each groove takes in pressurized gas until the groove ceases communication with the stationary port 21. The part capacity operation is a minimal capacity operation since the quantity of gas which is trapped is smaller than if the recess 23 were open. By adjusting the position of the slide, it is now the volumetric ratio which is adjusted, and not the capacity as was the case of the compressor in the second position of the slide. Indeed, adjusting the slide while maintaining the recess 23 covered results in delaying more or less registering of each groove with the low pressure, and thus expanding more or less of the gas in the grooves. In the first position, the full load operation is a variable increased load operation. The more the recess 23 is uncovered, the larger each groove is when the groove ceases registering with the high pressure and the larger the quantity of gas which is trapped in the groove.

The invention aims to vary the volumetric ratio and the capacity, but substantially separately rather than in a single operation, and the machine according to the present invention has that capability.

Another position is thermodynamically interesting because of the good efficiencies it ensures. It consists in displacing the body of the slide sufficiently far towards the high pressure to connect with the low pressure all thread-grooves engaged by the pinion-wheel, so that these latter do not compress any more; the capacity is then nil but the absorbed power is negligible except for mechanical friction or fanning losses.

Thus, with a single control means such as rod 12, it is possible in a first series of positions to vary the compression ratio at full load, then to achieve a part load in a second position.

Although interesting, this result is often insufficient since a two step capacity control is generally not enough for industrial refrigeration and air conditioning compressors above 20 kilowatt shaft power, a power above which screw compressors begin to have a satisfactory thermodynamic efficiency.

Having a compressor made of two half-compressors permits to eliminate this inconvenience and to achieve a 3 or 4 level capacity control, which is usual in machines in the 20–100 kilowatt range; the method of control is illustrated in FIGS. 5 to 10.

These figures show the bodies 10 and 11 of the slides, represented schematically on stretched views of the screw, similar to that of FIG. 4.

Figure 5:
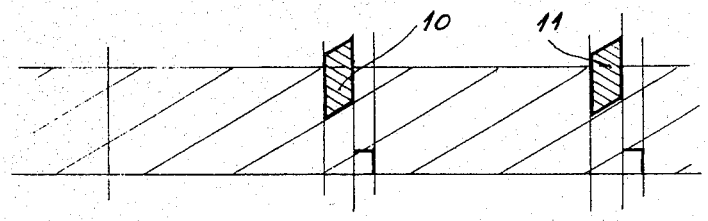
Figure 6:
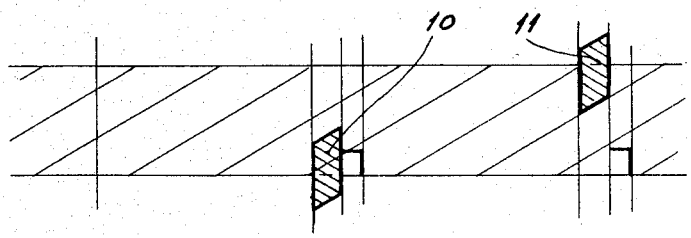

FIGS. 5 and 6 illustrate a three step control. FIG. 5 show the two slides in full load positions. On FIG. 6, slide 10 is in a part load position such as, for instance, to have the corresponding half compressor deliver only 16% of the full compressor capacity instead of 50%, while slide 11 remains in a full capacity position so that its half compressor delivers 50% of the maximum possible for the whole machine. The overall capacity thus amounts to 66% of the maximum delivery, which is the sum of the capacities of the two half compressors, that is, 16%+50%=66%.

Figure 7:
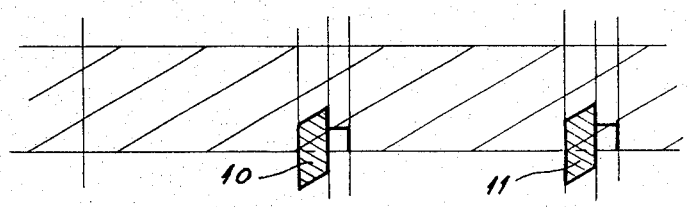

On FIG. 7, both slides are in the 16% position and the capacity is thus 32% of the full load capacity.

Figure 8:
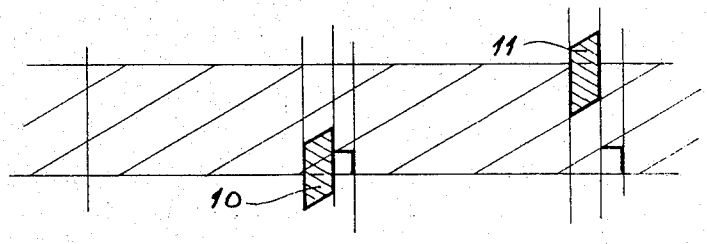

FIGS. 8, 9 and 10 show a 4-step control. In this case, the part load position of slide 10 corresponds to 25% of full capacity of the compressor whereas the part load position of slide 11 corresponds to no delivery.

The full delivery position is the same as in FIG. 5. By setting the slide 10 in the part load position and the slide 11 in the full load position, the total delivery is 75% of the maximum delivery (FIG. 8).

By setting the slide 11 in the part load position and the slide 10 in the full load position, the total delivery is 50% of the maximum delivery (FIG. 9).

When both slides 10, 11 are set in the part load position, the total delivery becomes 25% of the maximum delivery (FIG. 10).

Althrough in the positions illustrated by FIGS. 7 and 10, the compression ratios cannot be adjusted by moving the slides, they can still be adjusted in the positions shown in FIGS. 6 and 8, which are those of the first part load, nearest of the full load condition, and even in the second part load position of FIG. 9.

Indeed, in these positions, one slide at least remains in full load position and it is possible to have its compression ratio vary without varying the compressor capacity.

As indicated in the beginning of the specification, this ensures in this first part load condition the main advantage of the compression ratio variation as this variation remains possible on that half compressor that absorbs the most power and is rendered impossible only on that half compressor that absorbs the least, or even nothing in the case shown on FIG. 9.

In the preceding description, the device for controlling the position of the slide can be a manual one. But it may be interesting to automate it and FIG. 11 shows a possible automatic control device.

In this device, the body 10 comprises an orifice 30 allowing to pick up gas in the thread-groove under compression and to send it via a conduit 31 made axially inside the control rod 12 which is secured to the edge 18 of the slide body 10 and extends parallel to channel 8. At its end away from the slide body 10, the rod 12 carries a piston 32 slidably mounted in a bore 33 made in the casing 3. The piston 32 defines in bore 33, adjacent its face 39 away from body 10, a chamber 36. The conduit 31 extends through piston 32 and communicates with chamber 36. An aperture 34 and a valve 35 permit, when this latter is opened, to have chamber 36 communicate with low pressure (intake pressure).

A narrow projection—or plunger—37 is secured to the bottom 46 of bore 33 in chamber 36. The plunger 37 enters conduit 31 and thereby closes the latter when the slide 10 is in part load position, and is disengaged from conduit 31 when the slide 10 is in the full load position.

The operation now is as follows. When the half compressor corresponding to the slide now being considered is at full load, valve 35 is closed. The pressure that will be obtained in chamber 36 is approximately the average pressure prevailing in the compressor opposite the orifice 30.

Now it is well known that between the pressure so taken at a point of the slide and the pressure in the thread-groove at time of discharge, there is a ratio r, which, though not strictly fixed, varies only little when the slide is actuated.

On the other hand, the high pressure PH exerts on the piston-slide body assembly, a thrust on face 18, tending to push it towards low pressure, and also an antagonistic thrust on that face 38 of piston which faces body 10; the total is equivalent to a High Pressure thrust on an area s, s being the difference between the areas 38 and 18, the area 38 being larger. On face 39, that has an area S, pressure PM is present.

The area S, and the position of orifice 30 are chosen so that the ratio s/S be approximately equal to r; indeed, the piston is balanced when $S.PM=s.\ PH$, and thus it will come to the location where $$PM=(s/S)PH=r.PH$$

which ensures the desired result, i.e. to equal the compression ratio obtained at the time the thread registers with the discharge port and the ratio of high to low pressure.

If the valve 35 is now being opened, chamber 36 discharges and the piston is pushed until its face 39 abuts at the bottom 46 of the bore, which abutment defines the part load position of the slide. In this position, the conduit means 31 is closed by the plunger 37.

If the valve 35 is closed again, the leaks existing between the piston 32 and the bore 33 will increase the pressure in chamber 36 and push the piston 32 back until the plunger 37 exits from conduit 31; the length of said plunger has been chosen to bring back the slide to a full load position, so that the device can then operate as a compression ratio control system as described above.

Another improvement is also shown in FIG. 11. It is necessary for the slide to move at full load without unmasking the threads under compression, and then at part load while unmasking them partly or totally: this entails very long travels of the slide.

It is convenient to avoid the need of such travels by making the slide body of two elements 40 and 41.

Biasing means such as a compression spring 42 inserted between the casing 3 and the edge 17 urges the element 41 towards the high pressure, and thereby element 41 bears against element 40 in the full load position of the slide, and thus follows said element 40 when the position of the latter varies in order to accomodate varying compression ratios. At part load, the body 10 is drawn towards the high pressure; however, the element 41 has a finger 43 which comes to bear on an edge 44 of the casing which acts as a stop. The two elements 40 and 41 thereby separate and the gas, which starts being compressed, may flow back in a known way towards the low pressure through an orifice such as 45 visible on FIG. 12, made in the bottom of channel 8 opposite the interval thus appearing between elements 40 and 41.

The element 41 facing threads in the initial phase of compression, it can be given more play than element 40, which makes its movement easier, because the leaks have a negligible bearing on the efficiency, due to the low pressures involved.

The device has been described as a compressor, but it can apply to the case of an expansion engine, the direction of rotation of which is contrary to the direction 26 of FIG. 1.

Thus, the control device illustrated in FIG. 11 has the following two functions:

(1) Allowing the displacement of the slide from its part capacity condition to its full capacity condition and conversely, only by actuating a valve 35, which may, for example, be actuated manually.

(2) When the slide is in the full capacity condition, it automatically adjusts the volumetric ratio in order that the "just registering pressure", which is the pressure in a groove as it just begins to register with the high pressure port of the compressor, substantially equals the high pressure. This adapts the volumetric ratio of the compressor to the HP/LP ratio, which is the ratio between the pressures in the high pressure and low pressure ports.

First assume that the valve 35 is closed so that the situation is that which is illustrated in FIG. 11, and assume that the slide is in the position in FIG. 4 in which the edges are in the position 17*a* and 18*a*. Now consider any point on the slide face 16 which is opposite a groove closed by a pinion tooth and a slide but which is spaced from the edge 18*a*. For example, assume that such a point is on line 18 of FIG. 4. This point "sees" a fluctuating pressure: when the point just begins to see a given groove, the seen pressure is relatively low, and when the point finishes seeing the groove, the gas in the groove has been compressed and the point sees a higher pressure. Overall, the point sees a certain average pressure. There is a certain ratio r between the average pressure seen by the considered point and the "just registering pressure" when the groove first registers with the high pressure port. Of course, the ratio r depends on the geometric configuration of the machine. The ratio r remains substantially constant when the slide is actuated to adjust the volumetric ratio. Therefore, the pressure at the consideration point of the slide is an indication of the just registering pressure.

The pressure at the considered point on the slide is permanently present, except for the fluctuations described above, and thus may be physically sensed. On the contrary, the just registering pressure is not permanently present but is periodically present for very brief durations. At most points where such pressure is periodically present, but at other instants, the pressure is the exhaust pressure of the compressor, which is independent of the just registering pressure, which is the pressure to be evaluated. Therefore, there is no foreseeable relation between the just registering pressure and the average pressure at a point where the just registering pressure is periodically present. In contrast, as explained above, there is a determined relation between the average pressure at point 30 and the just registering pressure. Therefore, a simple means, that is, the exhaust pressure of the compressor and the just registering pressure, which could directly apply on opposite sides of a piston to make the piston move the slide until these pressures are equal would be inefficient.

As an exception to what has been said above about points periodically seeing the just registering pressure, point 30 could without any drawback see the just registering pressure just before ceasing to see each groove, but it would not be an advantage since, even in such a case, the average pressure at point 30 would not equal the just registering pressure. What is important is that no point of the casing permanently sees an average pressure which is equal to the just registering pressure. According to the present invention, there are opposed on two faces of the piston the exhaust pressure and the pressure at point 30. In order to have the piston move the slide until the exhaust pressure equals the just registering pressure, the surface of the piston subjected to the exhaust pressure must be in the ratio r with respect to the surface of the piston subjected to the pressure at point 30. In the example shown, the surface subjected to pressure at point 30 (PM) is the area of the surface 39. The area subjected to the exhaust pressure (PH) is the area of surface 30 minus the area of surface 18. Under these conditions, the piston 32 tends to stabilize in a location where the forces in both directions are equal, in other words, where PH equals PM/r. Since PM/r is also the just registering pressure, the piston stabilizes when the just registering pressure and the high pressure are equal. This is the result contemplated.

Opening and closing the conduit means 31 does not control the position of the slide. When the slide is in the full capacity position, it is necessary that the conduit 31 be open to allow regulation of the volumetric ratio as explained above. In contrast, if the slide is to be in the part capacity position, it is necessary that the slide be able to move to this location independently of whether the volumetric ratio is or is not adapted to the HP/LP ratio. According to the invention, the pressure at point 30, when applied to the piston for volumetric ratio regulation, urges the slide away from its full capacity condition, and for moving the slide to its part capacity condition, the pressure is dropped, for example down to the intake pressure, on that face of the piston which was subjected to pressure at point 30. This pressure drop allows the exhaust pressure to move the slide towards the part capacity condition. However, since the chamber 36 is at the intake pressure, it is necessary to close the duct 31 in order to avoid the escape of the gas already compressed in the grooves to the low pressure via the duct 31 and the valve 35. The plunger 37 is a device for selectively closing the duct 31 when needed.

The invention could also apply to a compressor comprising a screw co-operating with three pinions, two of which being provided with a slide; with three slides, the number of part load arrangements could be increased.

I claim:

1. A volumetric screw-and-pinion machine such as a compressor or an expansion machine comprising, in a combination, a screw having a cylindrical outer profile, provided with several threads and rotatably mounted inside a stationary casing, at least one pinion-wheel meshing with the screw, and a slide displaceably mounted near the pinion-wheel in a channel made in the casing parallel to the axis of the screw, the slide comprising a body located in the channel and having a concave face which matches with the cylindrical outer profile of the screw and two end-edges, one of which is on a low pressure side of the body and the other of which is on a high pressure side of the body, a stationary high pressure port being provided in the casing between the pinion-wheel and the channel, wherein the slide is movable between two conditions i.e. a first condition including a series of full load positions in which the slide body uncovers in the casing beyond the high pressure edge a high pressure portion of said channel, while the slide body, said high pressure portion of said channel and the stationary port are together substantially covering the threads of the screw which are in mesh with the pinion-wheel, and a second condition in which the slide body substantially obturates said high pressure portion of said channel and, remote from the high pressure edge, uncovers a low pressure portion of said channel extending over at least part of the threads which are in mesh with the pinion-wheel teeth, wherein in at least the first of said conditions, the slide is displaceable to vary the extent of the uncovered portion of said channel while maintaining obturation of the other portion of said channel.

2. A machine according to claim 1, wherein the body of the slide comprises two elements, separated in a direction transverse to the displacement direction of the slide, the element located on the low pressure side being provided with a stop limiting its travel towards the high pressure side.

3. A machine according to claim 1, wherein the slide body is in one piece.

4. A machine according to claim 1, comprising control means operable in the first condition of the slide for sensing the pressure in the casing at a point located opposite threads meshing with the pinion-wheel, for comparing the pressure at said point with the high pressure, and for displacing said point so as to maintain a substantially constant angular distance for the threads between said point and the very beginning of their registering with said high pressure portion of said channel if the comparison results in a difference with respect to a given ratio.

5. A machine according to claim 4, wherein the point is on the slide body.

6. A machine according to claim 5, wherein said control means comprises a hollow rod connecting a piston to the slide body adjacent the high pressure edge thereof, the hollow region of the rod connecting on the one hand a hole provided in the slide body at the pressure sensing point and on the other hand a chamber provided in a cylinder in which said piston is displaceable.

7. A machine according to claim 6, comprising means for selectively connecting said chamber with the low pressure, and means for obturating the hollow region in the rod when the slide is in the second condition.

8. A volumetric screw-and-pinion machine such as a compressor or an expansion machine comprising, in a combination, a screw having a cylindrical outer profile, provided with several threads and rotatably mounted inside a stationary casing, two pinion-wheels meshing with the screw, and a slide displaceably mounted near each pinion-wheel in a channel made in the casing parallel to the axis of the screw, each slide comprising a body located in the channel and having a concave face which matches with the cylindrical outer profile of the screw and two end-edges, one of which is on a low pressure side of the body and the other of which is on a high pressure side of the body, a stationary high pressure port being provided in the casing between the pinion-wheel and each channel, wherein each slide is movable between two conditions, i.e., a first condition in which the slide body uncovers in the casing beyond the high pressure edge, a high pressure portion of its channel while the slide body, said high pressure portion of its channel and the stationary port are together substantially covering the threads of the screw which are in mesh with the corresponding pinion-wheel and a second condition in which the slide body substantially obturates said high pressure portion of its channel and, remote from the high pressure edge, uncovers a low pressure portion of its channel extending over at least part of the threads which are in mesh with the pinion-wheel teeth, wherein in at least the first of said conditions, each slide is displaceable to vary the extent of the uncovered portion of its channel while maintaining obturation of the other portion of its channel.

9. A machine according to claim 8, wherein both stationary ports are similarly positioned with respect to the respective adjacent pinion-wheel, and the second condition is axially the same for both slides.

10. A machine according to claim 8, wherein, in the second condition of one of the slides, all the threads which are in mesh with the corresponding pinion-wheel register with one of said low pressure portion of the channel and the stationary port, whilst in the second condition of the other slide, only a part of the threads which are in mesh with the pinion-wheel register with one of said low pressure portion of the channel and the stationary port.

11. A method of operating a volumetric screw-and-pinion machine such as a compressor or an expansion machine including a screw having a plurality of threads and a cylindrical outer profile, the screw being rotatably mounted inside a stationary casing, two pinion-wheels meshing with the screw, and a slide displaceably mounted near each pinion-wheel in a channel in the casing parallel to the axis of the screw, each slide comprising a body located in the channel and having a concave face which matches with the cylindrical outer profile of the screw and two end-edges, one of which is on a low pressure side of the body and the other of which is on a high pressure side of the body, a stationary high pressure port being provided in the casing between the pinion-wheel and each channel, wherein each slide is movable between a first condition in which the slide body uncovers in the casing beyond the high pressure edge, a high pressure portion of its channel while the slide body, said high pressure portion of its channel and the stationary port are together substantially covering the threads of the screw which are in mesh with the corresponding pinion-wheel and a second condition in which the slide body substantially obturates said high pressure portion of its channel and, remote from the high pressure edge, uncovers a low pressure portion of its channel extending over at least part of the threads which are in mesh with the pinion-wheel teeth, wherein in at least the first of said conditions, each slide of displaceable to vary the extent of the uncovered portion of its channel while maintaining obturation of the other portion of its channel, the method comprising the steps of:

axially positioning the two slides in one of the relationships in which:

(a) the two slides are at the first condition thereof for full capacity operation of the machine, (b) one of the slides in in the second condition and the other slide is in the first condition for a first part capacity operation of the machine, (c) the other of the slides is in the second condition and the first slide is in the first condition for a second part capacity operation of the machine, and (d) both slides are in the second condition for a third part capacity operation of the machine; and adjusting the location in the first condition of any of said slides which are in said first condition in order to set a desired volumetric ratio.

* * * * *